US005427063A

United States Patent [19]

Anderson

[11] Patent Number: 5,427,063

[45] Date of Patent: Jun. 27, 1995

[54] VARIABLE COMPRESSION RATIO CYLINDER

[76] Inventor: Eric M. Anderson, 23418 68th Ave., South, Kent, Wash. 98032

[21] Appl. No.: 298,396

[22] Filed: Aug. 30, 1994

[51] Int. Cl.[6] ..... F22B 75/04

[52] U.S. Cl. ..... 123/48 A; 123/48 AA

[58] Field of Search ..... 123/48 R, 48 A, 48 AA, 123/78 R, 78 A, 78 AA

[56] References Cited

U.S. PATENT DOCUMENTS

| | | | |
|---|---|---|---|
| 1,979,746 | 11/1934 | Kenneweg | 123/78 A |
| 2,367,894 | 1/1945 | Shore | 123/48 AA |
| 2,733,694 | 2/1956 | Brebeck | 123/48 AA |
| 4,137,873 | 2/1979 | Caswell, Sr. | 123/78 B |
| 4,148,284 | 4/1979 | Prosen | 123/78 C |
| 4,190,024 | 2/1980 | Davis | 123/48 A |
| 4,241,703 | 12/1980 | Lin-Liaw | 123/78 A |
| 4,406,116 | 9/1983 | Burnham | 123/48 R |
| 5,341,771 | 8/1994 | Riley | 123/48 AA |

*Primary Examiner*—Henry C. Yuen
*Assistant Examiner*—M. Macy
*Attorney, Agent, or Firm*—Craine & Jackson

[57] ABSTRACT

An internal combustion engine having at least one volume adjustable cylinder which automatically adjusts its compression ratio during operation. The volume adjustable cylinder includes a movable head insert placed inside the insert space formed on the engine head directly over the piston. An adjustable lock nut is used to attach the head insert to the engine head and to initially set the position of the head insert in the insert space to establish the initial volume of the combustion chamber of the cylinder. An O-ring made of elastomeric material is disposed between the head insert and the inside surface of the engine head which resists movment of the head insert in the insert space. When the engine operates at higher RPMs, the compression pressure increases inside the cylinder which forces the head insert into the insert space to expand the volume of the combustion chamber which, in turn, reduces the combustion pressure of the cylinder. A lip structure or stop pins are formed on the head insert which limit the movement of the head insert in the insert space.

19 Claims, 4 Drawing Sheets

VARIABLE COMPRESSION RATIO CYLINDER

BACKGROUND OF THE INVENTION

1. Field of the Invention

This invention relates to internal combustion engines and, more particularly, to internal combustion engines having means to adjust the compression ratios of the cylinders contained therein.

2. Description of the Related Art

Using variable compression ratio cylinders in an internal combustion engine to improve engine efficiency and reduce engine emissions are well known.

Several variable compression ratio cylinder designs are found in the prior art. For example, Prosen (U.S. Pat. No. 4,148,284) discloses a variable compression ratio engine with cylinders having inner and outer sleeves whose relative movement varies the cylinder volume to change the compression ratio of the engine. A complex hydraulic means responsive to the pressure in the combustion chamber automatically varies the position of the inner and outer sleeves to regulate the volume of the combustion chamber.

Coswell, Sr. (U.S. Pat. No. 4,137,873) discloses a variable compression ratio cylinder having a piston with a head portion with a flexible top wall located adjacent to the combustion chamber which flexes downward under high compression conditions to increase the volume of the combustion chamber.

Burnham (U.S. Pat. No. 4,046,116) discloses a means and method for increasing the compression ratio of the cylinder of an overhead valve engine by attaching plates having different thicknesses to the top face of the piston to reduce the volume of the combustion chamber.

The one disadvantage of these cylinder designs is that they require extensive modifications to the pistons or the cylinder heads. Another disadvantage is that they do not allow the mechanic to initially set and selectively control the amount of change in the volume of the combustion chamber during operation.

SUMMARY OF THE INVENTION

It is an object of the invention to provide an internal combustible engine with at least one variable compression ratio cylinder.

It is another object to provide such an engine in which the variable compression ratio cylinder is provided by adjusting the volume of the combustion chamber during use.

It is another object to provide such an engine in which the volume of the combustion chamber automatically changes between limits set by the user.

It is a further object to provide such an engine in which the means used to change in volume of the combustion chamber is relatively simple and inexpensive.

Accordingly, an internal combustion engine is provided with at least one variable compression ratio cylinder. The cylinder includes a cylinder volume adjustment means which enables the volume of the cylinder's combustion chamber to be initially set and then automatically expanded as compression pressure inside the cylinder increases. The cylinder volume adjustment means includes a moveable head insert disposed inside a complimentary-shaped insert spaced formed on the lower surface of the engine head directly over the piston. A biasing means is disposed between the head insert and the engine head which forces the head insert downward in the insert space when the engine is off or when operating at low RPMs. When the engine is operated at higher RPMs and the compression pressure in the cylinder increases, the biasing means enables the head insert to move upward in the insert space to expand the volume of the combustion chamber. As the volume of the combustion chamber is increased, the compression ratio of the cylinder is reduced which leads to improved engine efficiency. A stop means is provided to limit the upward movement of the head insert in the insert space. In one embodiment, the stop means is selectively adjustable by the user so that the maximum volume of the combustion chamber may be selected for different engine designs and different grades of fuel. Various biasing means having different thicknesses, elastic properties and spring rates are also disclosed which enable the user to adjust the rate of movement of the head insert in the combustion chamber.

DESCRIPTION OF THE PREFERRED EMBODIMENT(S)

Figure 1:
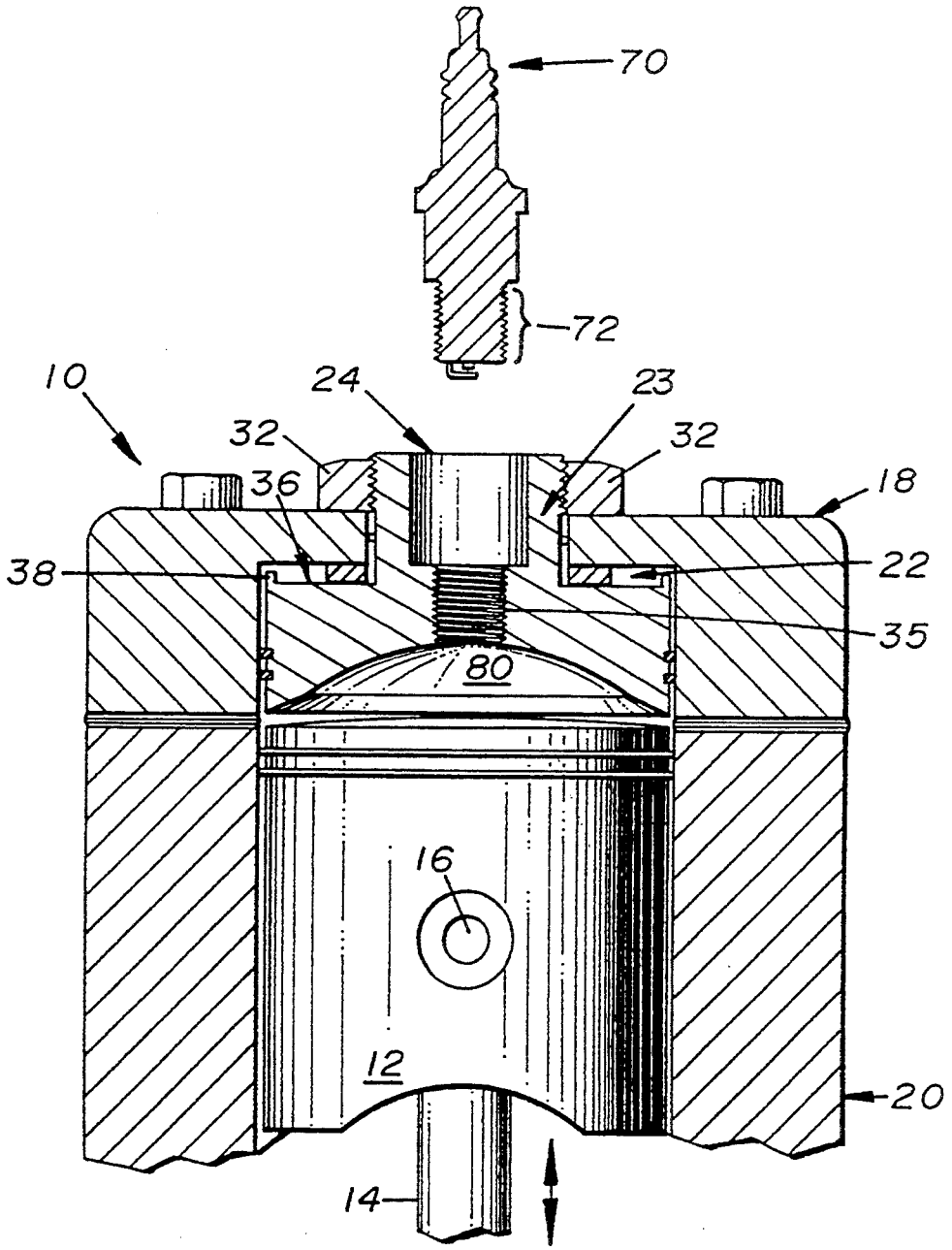
FIG. 1 is a vertical cross-sectioned view of a cylinder showing the invention described herein.

Referring now to the drawings, there is disclosed a cylinder, generally referred to as 10, of a two-stroke internal combustion engine designed to automatically adjust the compression ratio of the cylinder 10 by automatically adjusting the volume of the cylinder's combustion chamber 80 of the cylinder 10 while the engine is operating. Typically, the cylinder 10 includes a piston 12 with a connecting rod 14 interconnecting the piston pin 16 to a crank shaft (not shown). An engine head 18 is attached to the engine block 20 in which the cylinder 10 resides.

The volume of the cylinder 10 is initially set and automatically adjusted during operation of the engine by a moveable head insert 24 disposed inside an insert space 22 formed on the inside surface of the engine head 18. The head insert 24 is designed to move longitudinally inside the insert space 22 in response to opposing forces exerted on the head insert 24 by compression and a biasing means disposed between the head insert 24 and the engine head 18. When the upward compression forces exceeds the downward force exerted on the head insert 24 by the biasing means, the head insert 24 moves upward in the insert space 22 to expand the volume of the combustion chamber 80. When the downward force exerted on the head insert 24 by the biasing means exceeds the upward compression forces exerted on the head insert 24, the head insert 24 moves downward in the insert space 22 to reduce the volume of the combustion chamber 80.

Figure 2:
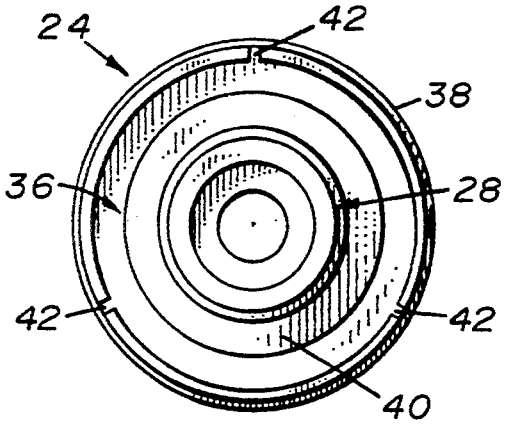
FIG. 2 is a top plan view of the head insert.
Figure 3:
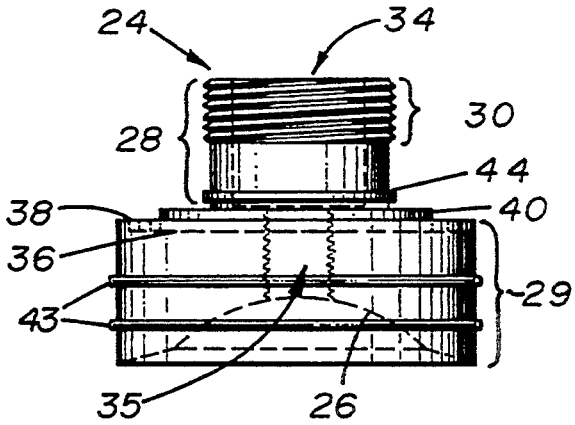
FIG. 3 is a cross-sectional, side-elevational view of the head insert shown in FIG. 2.

The head insert 24, shown in FIGS. 1—3, is cylindrical-shaped with a lower, concave surface, hereafter called a dome surface 26, which forms the upper surface of the combustion chamber 80. The head insert 24 includes an upper, cylindrical-shaped neck 28 and an integrally formed lower, cylindrical-shaped body 29. The neck 28 is sufficient in length to enable it to extend through a longitudinally aligned bore 23 manufactured on the engine head 18 directly over the cylinder 10 when the head insert 24 is placed into the insert space 22. External threads 30 are manufactured on the upper portion of the neck 28 so that a locking nut 32, having complimentary internal threads 34 formed thereon, may be connected to the neck 28 to keep the head insert 24 from falling into the cylinder 10. Manufactured inside the neck 28 is a longitudinally aligned, cylindrical-shaped cavity 34 which extends from the top surface of the neck 28 to approximately the midpoint of the head insert 24. Manufactured on the inside surface of the cavity 34 is a smaller diameter, longitudinally aligned threaded bore 35 which extends through the lower body 29 to the dome surface 26. During assembly, a spark plug 70 is inserted into the cavity 34 and connected via external threads 72 to the threaded bore 35 with the spark plug's electrode extending into the combustion chamber 80.

The lower body 29 of the head insert 24 is larger than the neck 28, so that a flat, outward extending annular surface 36 is formed thereon. The height and diameter of the insert space 22 is slightly larger than the height and diameter of the lower body 29 so that the head insert 24 may freely move longitudinally therein. Also, the overall height of the head insert 24 is sufficiently small so that the dome surface 26 clears the upper surface of the piston 12 while at top dead center when the neck 28 is extended through bore 23.

On the first embodiment of the head insert 24, shown in FIGS. 1–3, a circular lip 38 is formed near the peripheral edge of the annular surface 36 which, during operation, acts as a stop means to limit the upward movement of the head insert 24 in the insert space 22. Located around the lip structure 38 are a plurality of openings 42 designed to enable water or air to escape during engine operation. One or more lower sealing rings 43 are manufactured on the outer sides of the lower body 29 of the head insert 24 which form a tight seal between the outer sides of the lower body 29 and the inside, vertical surfaces of the engine head 18. An optional, upper sealing ring 44 may also be disposed on the outer surface of the neck 28 to provide a seal between the neck 28 and walls of the bore 23.

As shown in FIGS. 4(*a*) and 4(*b*), when the head insert 24 is placed in the insert space 22 on the engine head 18, the neck 28 extends through the bore 23 and the annular surface 36 is disposed slightly below the upper, inside surface of the engine head 18. The neck 28 is sufficient in length so that a locking nut 32 may be attached to the neck 28 and the biasing means may be disposed on the annular surface 36 to create an expansion space between the inside surface of the engine head 18 and the annular surface 36. During use, the biasing means resists compression to force the head insert 24 downward in the insert space 22. When sufficient upward compression force is applied to the dome surface 26 on the head insert 24, the biasing means compresses to allow the head insert 24 to move upward in the insert space 22 thereby expanding the volume of the combustion chamber 80. When the upward compression force decreases, the biasing means forces the head insert 24 back to its original position.

In the preferred embodiment, the biasing means is an O-ring 40 made of elastomeric material disposed on the annular surface 36 and around the base of the neck 28. The O-ring 40 has sufficient thickness and elasticity so that the head insert 24 may move approximately 0.03 to 0.05 inches in the insert space 22. When used on the head insert 24, the distance between the end of the lip structure 38 and the inside surface of the engine head determines the maximum distance traveled by the head insert 24. It should be understood that the O-ring 40 may be replaced with items which function in a similar manner, such as a spring washer, a quad-ring or ring gasket made of elastomeric material, or spring.

During assembly, the locking nut 32 is then attached to the external threads 30 until the upper surface of the O-ring 40 is pressed against the inside surface of the engine head 18. By further tightening the locking nut: 32 on the neck 28, the head insert 24 may be pulled upward in the insert space 22 to position the annular surface 36 closer to the inside surface of the engine head 18. As the locking nut 32 is tightened, the O-ring 40 is forcibly pressed against the inside surface of the engine head 18 and the distance between the end of the lip structure 38 and the inside surface of the engine head 18 is reduced. Thus, by adjusting the position of the lock nut 32 on the neck 28 in this manner, the user may use the locking nut 32 to set the initial position of the head insert 24 in the insert space 22 and to establish the expandable volume of the combustion chamber 80.

Figure 5:
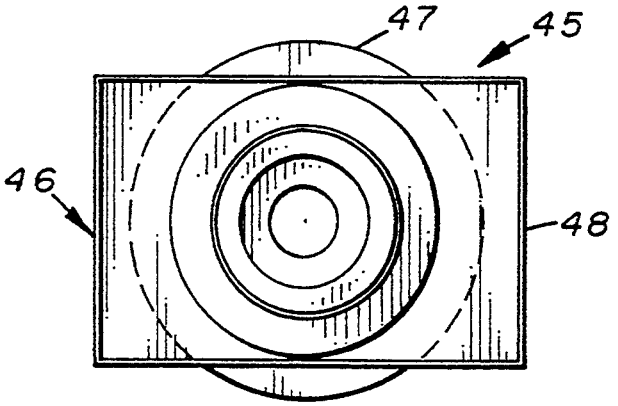
FIG. 5 is a top plan view of an alternative embodiment of the head insert.
Figure 6:
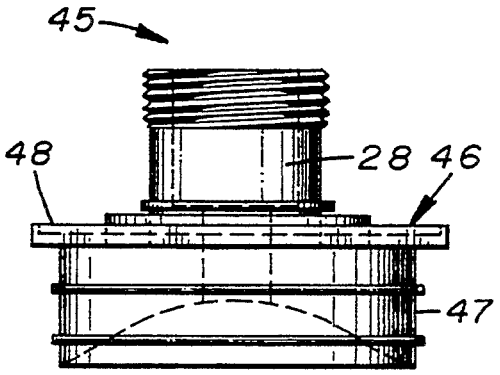
FIG. 6 is a cross-sectional, side-elevational view of an alternative head insert shown in FIG. 5.
Figure 7:
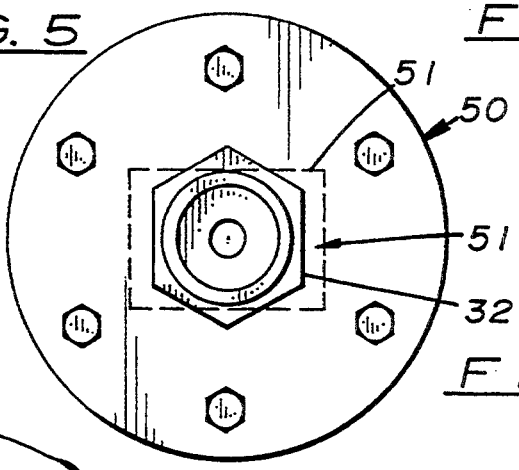
FIG. 7 is a top plan view of the cylinder with the head insert shown in FIGS. 6 and 7 used therein.

When attaching the locking nut 32 to the neck 28, the head insert 24 may rotate inside the insert space 22 making attachment difficult. FIGS. 5, 15 and 7 show another embodiment of the head insert, denoted as reference number 45, which includes an anti-rotational means used to prevent this rotation. The head insert 45 includes a rectangular-shaped, upper portion 46 formed on the upper surface of the lower body 47 which fits snugly in a complimentary-shaped, recessed space 51 formed on the inside surface of a modified engine head 50. When the head insert 45 is placed into the insert space and the upper portion 46 is placed into the recessed space 51, the head insert 45 is prevented from turning thereby enabling the locking nut 32 to be easily attached to the neck 28. During assembly, the O-ring 40 is disposed around the base of neck and over the upper portion 46. A lip structure 48 is formed along the peripheral edge of the upper portion 46 which acts as a stop means, like lip structure 38, to limit upward movement of the head insert 45 inside the insert space.

Figure 8:
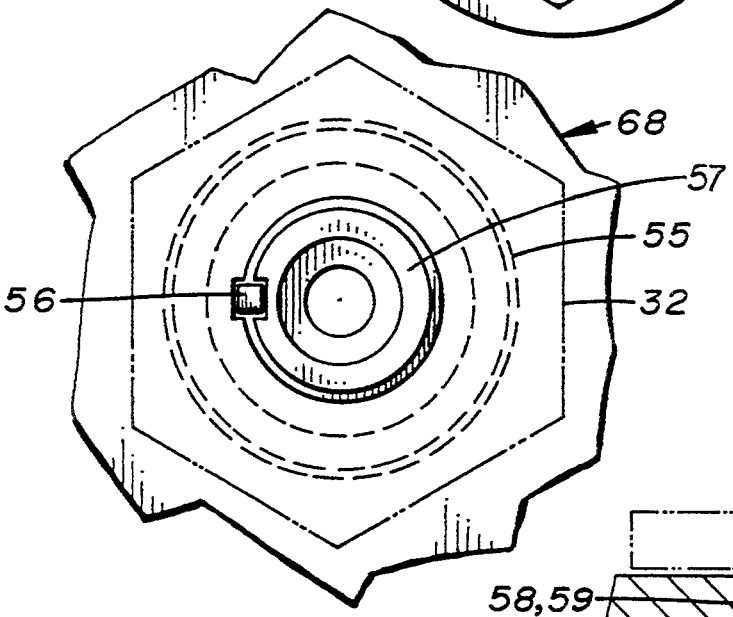
FIG. 8 is a top plan view of the cylinder showing another alternative embodiment of the head insert with a Woodruff key inserted in a keyway formed in the neck.
Figure 9:
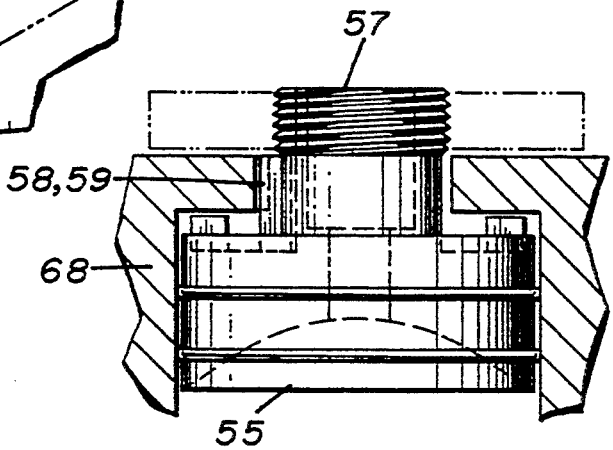
FIG. 9 is a side elevational view of the alternative embodiment of the head insert shown in FIG. 8.

FIGS. 8 and 9 show still another embodiment of the anti-rotational means used on a head insert 55 comprising a longitudinally aligned woodruff key 56 positioned longitudinally along the outside surface of the neck 57. The woodruff key 56 fits inside two, complimentary shaped keyways 58 and 59 formed on one side of the bore 60 and neck 57, respectively, which act to prevent rotation of the head insert 55 when being attached to the engine head 68.

Figure 10:
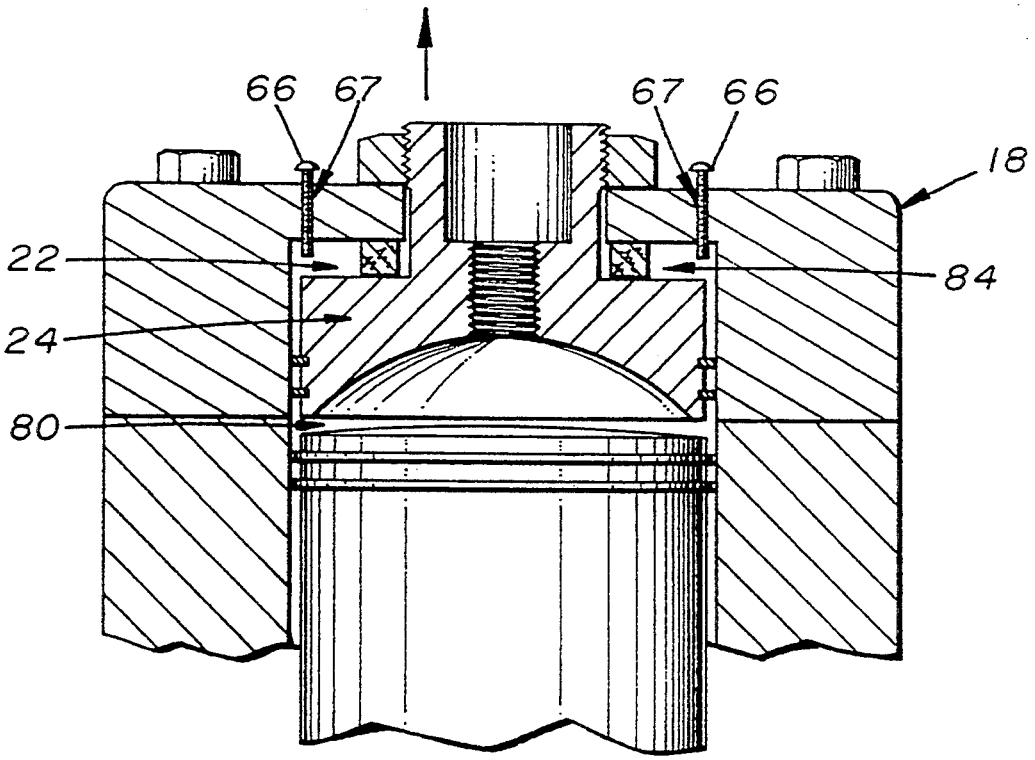
FIG. 10 is a partial, side elevational view of an alternative embodiment of the invention with adjustable stop pins extending through the engine head.

FIG. 10 shows another embodiment of the invention with an adjustable stop means used in place of lip structure 38 disposed between the head insert 24 and the engine head 18 which enables the user to selectively adjust the distance traveled by the head insert 24 in the insert space 22. In one embodiment, the adjustable stop means comprises three threaded stop pins 66 spaced approximately 120 degrees apart over the cylinder 10. The stop pins 66 extend downward through the threaded bores 67 manufactured on the engine head 18 directly over the insert space 22. The threaded stop pins 66 are turned to adjust the length they extend into the insert space 22. By adjusting the length of the stop pins 66 into the insert space 22, upward movement of the head insert 24 is limited which, in turn, limits the amount of expandable volume of the combustion chamber 80. To increase the volume of the combustion chamber 80, the threaded stop pins 66 are turned in the opposite direction to reduce the length they extend into the insert space 22 thereby allowing the head insert 24 to move upward. In this manner, the user is able to selectively adjust the expandable volume of the combustion chamber 80.

Figure 11:
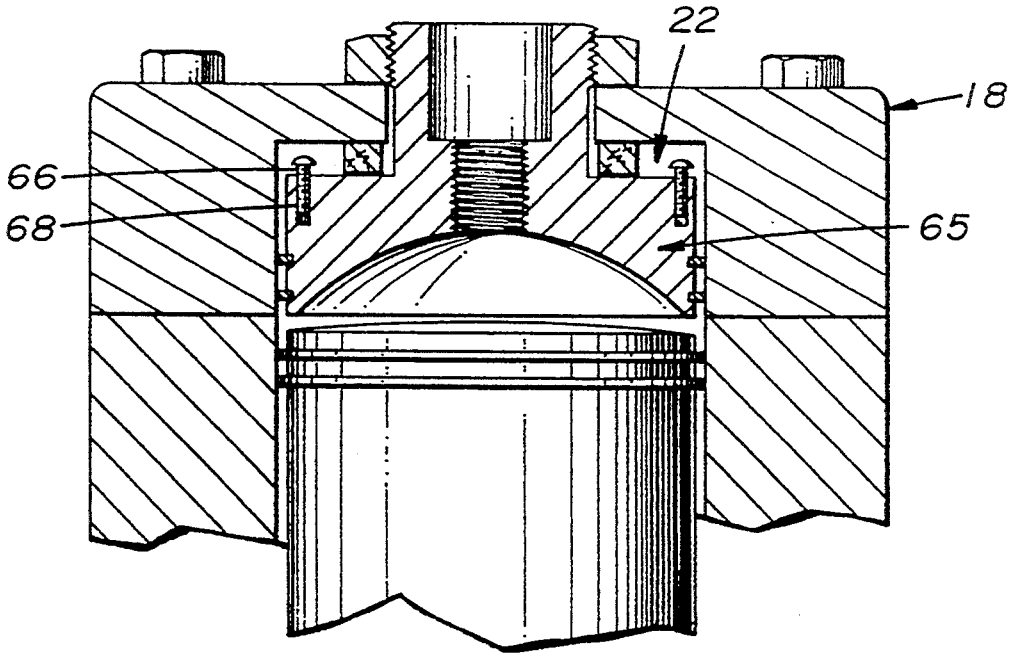
FIG. 11 is a side elevational view of an alternative embodiment of the head insert with adjustable stop pins attached thereto.

FIG. 11 shows another embodiment of the head insert 65 with three, upward extending, threaded stop pins 66 attached directly thereto. The threaded stop pins 66 are connected to threaded bores 68 formed in the head insert 65. When the head insert 65 is placed into the insert space 22, the distal ends of the threaded stop pins 66 touch the upper, inside surface of the engine head 18 to limit upward movement of the head insert 65.

The cylinder 10 is assembled by first disposing the O-ring 40 over the annular surface 36 on the head insert 24. After the O-ring 40 is placed on the head insert 24, the head insert 24 is then placed into the insert space 22 on the engine head 18 so that the neck 28 extends through the bore 23. The locking nut 32 is then attached to the external threads 30 on the neck 28 until the upper surface of the O-ring 40 presses against the inside surface of the engine head 18. A spark plug 70 is then connected to the bore 35. The engine head 18 is then attached to the engine block 20. After connecting an ignition wire to the spark plug 70, the engine is then ready for operation.

During operation, the piston 12 continuously moves up and down inside the cylinder 10. The initial volume of the combustion chamber 80 of the cylinder 10 is determined by the volume of the combustion chamber 80 located below the dome surface 29 of the head insert 24. By tightening or loosing the locking nut 22 on the neck 28 and/or exchanging head inserts 24 and O-rings 40 having different thickness, the user is able to adjust the initial volume of the combustion chamber 80 for different engine applications and different grades of fuel.

Figure 4A:
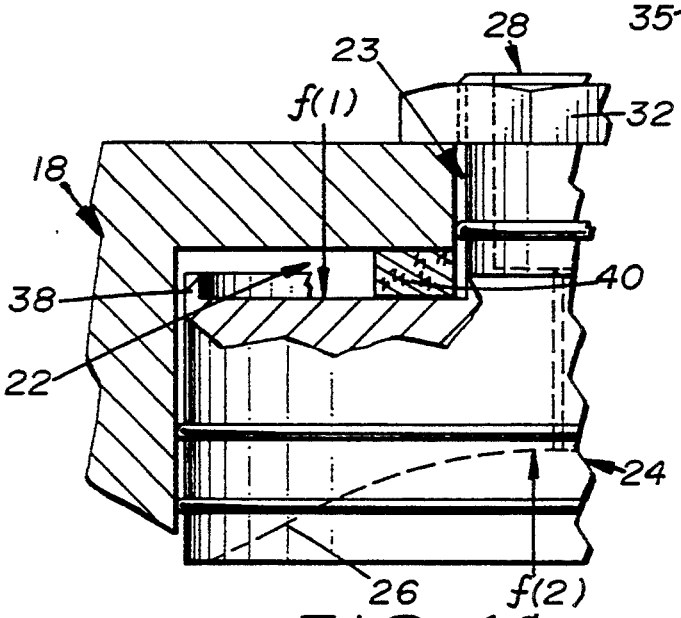
FIG. 4*a* is a partial, side elevational view, in section, of the head insert showing its initial position inside the cylinder.
Figure 4B:
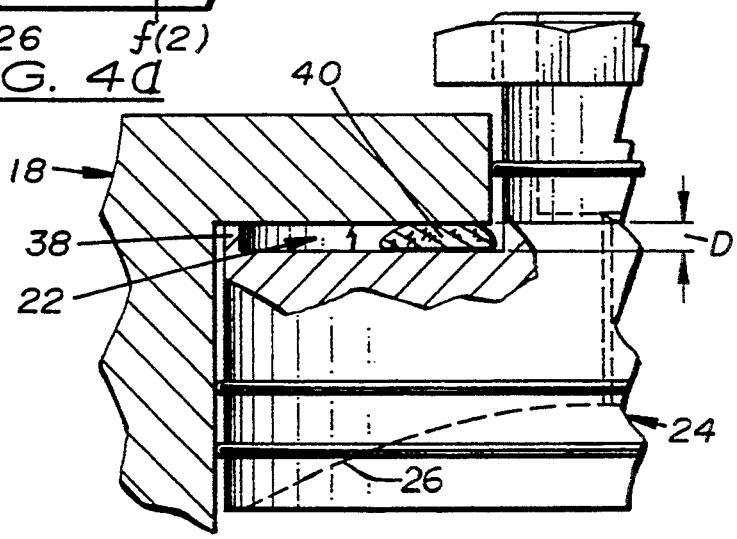
FIG. 4*b* is a partial side elevational view, in section, of the head insert shown in FIG. 4*a* moved upward in the cylinder.

As the engine's RPMs are increased, pressure exerted on the dome surface 26 forces the head insert 24 upward in the insert space 22, thereby expanding the volume of the combustion chamber 80 as shown in FIGS. 4*a* and 4*b*. The rate of change in volume is determined, in part, by the elastic properties of the O-ring 40. The maximum expandable volume of the combustion chamber 80 is determined by the allowable distance traveled by the head insert 24 is determined by the height of the lip structure 38 or the length of the adjustable stop pins 65 extended into the insert space 22.

In compliance with the statute, the invention described herein has been described in language more or less specific as to structural features. It should be understood, however, the invention is not limited to the specific features shown, since the means and construction shown comprise only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An internal combustion engine having at least one variable compression ratio cylinder, said cylinder comprising:

a. a reciprocating piston housed inside an engine block;

b. an engine head attached to said engine block and over said piston to form a combustion chamber in said cylinder, said engine block having an insert space formed therein;

c. a head insert disposed inside said insert space on said engine, said head insert capable of moving in said insert space to expand the volume of said combustion chamber in said cylinder during operation of said engine in response to increased combustion pressure created in said cylinder;

d. an adjustable locking means used to selectively attach said head insert to said engine head and to selectively establish an initial volume for said combustion chamber, said adjustable locking means also enabling said head insert to move in said insert space in response to increased compression pressure created in said cylinder;

e. a biasing means disposed between said head insert and said engine head, said biasing means capable of resiliently opposing the compression pressure exerted on said head insert during operation of said engine to control the change of volume of said combustion chamber, and;

f. a stop means disposed between said head insert and said engine head capable of limiting the amount of movement of said head insert in said insert space to thereby establish a maximum expandable volume of said combustion chamber.

2. An internal combustion engine having at least one variable compression ratio cylinder, as recited in claim 1, wherein said stop means is an extending lip structure formed on said head insert which makes contact with said engine head and thereby prevents further movement of said head insert in said insert space.

3. An internal combustion engine having at least one variable compression ratio cylinder, as recited in claim 1, wherein said stop means is a stop pin disposed between said head insert and said engine head.

4. An internal combustion engine having at least one variable compression ratio cylinder, as recited in claim 3, wherein said stop means is adjustable thereby enabling a user to adjust the distance traveled by said head insert in said insert space.

5. An internal combustion engine having at least one variable compression ratio cylinder, as recited in claim 1, wherein said biasing means is an O-ring structure made of elastomeric material.

6. An internal combustion engine having at least one variable compression ratio cylinder, as recited in claim 2, wherein said biasing means is an O-ring structure made of elastomeric material.

7. An internal combustion engine having at least one variable compression ratio cylinder, as recited in claim 3, wherein said biasing means is an O-ring structure made of elastomeric material.

8. An internal combustion engine having at least one variable compression ratio cylinder, as recited in claim 4, wherein said biasing means is an O-ring structure made of elastomeric material.

9. An internal combustion engine having at least one variable compression ratio cylinder, said cylinder comprising:

a. a reciprocating piston housed inside an engine block;

b. an engine head attached to said engine block and over said piston to form a combustion chamber in said cylinder, said engine head having a longitudinally aligned central bore and an insert spaced formed therein directly over said piston;

c. a head insert disposed inside said insert space on said engine head, said head insert having a neck portion and a body portion, said neck portion having external threads and being capable of extending through said central bore on said engine head, said body portion capable of being disposed inside said insert space and capable of moving longitudinally therein to increase the volume of said combustion chamber of said cylinder in response to an increase in said compression pressure created in said cylinder therein during the operation of said engine;

d. a lock nut attached to said neck of said head insert capable of attaching said head insert to said engine head and capable of setting the initial volume of said combustion chamber;

e. a biasing means disposed between said head insert and said engine head, said biasing means capable of resiliently opposing the compression pressure exerted on said head insert during combustion to control the change of volume of said combustion chamber, and;

f. a stop means disposed between said head insert and said engine head capable of limiting the amount of movement of said head insert in said combustion chamber to set the maximum expandable volume of said combustion chamber.

10. An internal combustion engine having at least one variable compression ratio cylinder, as recited in claim 9, wherein said stop means is an extending lip structure disposed between said head insert and said cylinder.

11. An internal combustion engine having at least one variable compression ratio cylinder, as recited in claim 9, wherein said stop means is a stop pin that extends from said said engine head to make contact with said head insert.

12. An internal combustion engine having at least one variable compression ratio cylinder, as recited in claim 11, wherein said stop means is adjustable to enable an user to adjust the length of said stop pin and thereby adjust the distance traveled by said head insert in said insert space.

13. An internal combustion engine having at least one variable compression ratio cylinder, as recited in claim 11, wherein said biasing means is an O-ring structure made of elastomeric material.

14. An internal combustion engine having at least one variable compression ratio cylinder, as recited in claim 12, wherein said biasing means is an O-ring structure made of elastomeric material.

15. An internal combustion engine having at least one variable compression ratio cylinder, said cylinder comprising:

a. a reciprocating piston housed inside an engine block;

b. an engine head attached to said engine block and over said piston to form a cylinder, said engine head having a longitudinally aligned central bore and a longintudinally aligned insert spaced formed therein;

c. a head insert capable of being moveably disposed inside said insert spaced formed on said engine head, said head insert having a neck portion and a body portion, said neck portion having external threads and being capable of extending through said central bore of said engine head, said head insert capable of moving longitudinally inside said insert space to adjust the volume of the combustion chamber of said cylinder in response to the amount of compression pressure created in said cylinder during the operation of said engine;

d. an adjustable lock nut attached to said neck of said head insert to set the initial position of said head insert in said cylinder;

e. an O-ring made of elastomeric material disposed between said head insert and said engine head, said O-ring means being capable of resiliently opposing compression forces exerted on said head insert during combustion, and;

f. stop pins disposed between said head insert and said engine head capable of limiting the amount of movement of said head insert in said insert space to determine the maximum volume of said cylinder.

16. An internal combustion engine having at least one variable compression ratio cylinder, as recited in claim 15, wherein said stop means is adjustable to enable an user to adjust the length of said stop pin and thereby adjust the distance traveled by said head insert in said insert space.

17. An internal combustion engine having at least one variable compression ratio cylinder, as recited in claim 15, further including an anti-rotation means disposed between said head insert and said engine head to prevent rotational movement of said head insert in said insert space when attaching said head insert to said engine head.

18. An internal combustion engine having at least one variable compression ratio cylinder, as recited in claim 17, wherein said anti-rotation means includes said head insert having a raised upper portion and a complimentary-shaped recessed spaced form on said engine head capable of being interconnected to prevent said head insert from rotating when connected thereto.

19. An internal combustion engine having at least one variable compression ratio cylinder, as recited in claim 17, wherein said anti-rotation means includes a woodruf key and complimentary-shaped keyway disposed between said head insert and said engine head capable of being interconnected to prevent said head insert from rotating when connected thereto.

* * * * *